US010281243B2

(12) United States Patent
Macias et al.

(10) Patent No.: US 10,281,243 B2
(45) Date of Patent: May 7, 2019

(54) CONVERTIBLE BALLISTIC SHIELD FOR VEHICULAR AND PERSONAL USE

(71) Applicants: Alejandro Macias, Miami, FL (US); Gustavo Zuloaga, Miami Beach, FL (US)

(72) Inventors: Alejandro Macias, Miami, FL (US); Gustavo Zuloaga, Miami Beach, FL (US)

( * ) Notice: Subject to any disclaimer, the term of this patent is extended or adjusted under 35 U.S.C. 154(b) by 0 days.

(21) Appl. No.: 15/361,577

(22) Filed: Nov. 28, 2016

(65) Prior Publication Data

US 2018/0149450 A1 May 31, 2018

(51) Int. Cl.
*F41H 5/08* (2006.01)

(52) U.S. Cl.
CPC ..... *F41H 5/08* (2013.01)

(58) Field of Classification Search
USPC ..... 89/36.02, 36.07
See application file for complete search history.

(56) References Cited

U.S. PATENT DOCUMENTS 2,020,702 A * 11/1935 Russell ..... F41H 5/08 109/58.5
6,161,462 A * 12/2000 Michaelson ..... F41H 5/06 102/303
6,807,890 B1 * 10/2004 Fuqua ..... F41H 5/08 89/36.02
7,971,516 B2 7/2011 Hogan
8,210,088 B1 * 7/2012 Keyfauver ..... F41H 5/08 89/36.05
8,573,704 B2 * 11/2013 Peters ..... A47C 3/04 297/239
9,170,072 B1 10/2015 Riggs
2012/0118135 A1 * 5/2012 Warren ..... B60J 1/2011 89/36.02
2012/0174768 A1 * 7/2012 Spransy ..... F41H 5/013 89/36.09
2016/0061569 A1 * 3/2016 Fernandez ..... F41H 5/04 89/36.02
2016/0187106 A1 * 6/2016 Roberts ..... F41H 5/08 89/36.02
2017/0167826 A1 * 6/2017 Spransy ..... F41C 27/04

* cited by examiner

*Primary Examiner* — Samir Abdosh
(74) *Attorney, Agent, or Firm* — Max Kaganov

(57) ABSTRACT

A ballistic shield convertible between a folded configuration and an unfolded configuration is disclosed. The ballistic shield includes a first ballistic panel including a ballistic material, and a second ballistic panel including a ballistic material. A pivotable connection between the first ballistic panel and the second ballistic panel is disposed such that, when the ballistic shield is in the unfolded configuration, an overlapping area exists between a portion of the first ballistic panel and a portion of the second ballistic panel.

17 Claims, 6 Drawing Sheets

CONVERTIBLE BALLISTIC SHIELD FOR VEHICULAR AND PERSONAL USE

BACKGROUND

Police, military personnel, security personnel, and other enforcement officers frequently find themselves in dangerous conditions where bodily protection is necessary. Such protection can be provided by ballistic (i.e., "bulletproof") shields that are capable of impeding penetration of the shield by a variety of handheld arms ordnance. Typically, such shields are large, bulky, and require ample space for storage in a vehicle. Consequently, in an immediate threat situation, an enforcement officer may not have the time or ability to retrieve the ballistic shield from storage. Moreover, enforcement officers are also susceptible to attack when seated inside their vehicles, as vehicle doors typically do not have sufficient strength to protect the occupants of the vehicle from bullets and other projectiles. In addition, certain threat situations also require that the enforcement official exit the vehicle and utilize the vehicle door for concealment from an armed assailant. While the vehicle door may offer partial concealment, it still does not offer ballistic protection that is necessary in such situations.

Therefore, a ballistic shield that is capable of providing protection for both the upper body and lower body of a person seated in a vehicle is desired. A readily accessible and deployable ballistic shield that can provide protection for the upper body and lower body of a standing person, as well as for a person concealed or crouching behind a car door is also desired. It is further desired a ballistic shield include the combination of these modes of protection, and that the shield be easily and rapidly convertible between such modes.

SUMMARY

According to one exemplary embodiment, a ballistic shield is disclosed. The ballistic shield may include an upper panel hingedly or flexibly coupled to a lower panel. The shield may be convertible between an unfolded configuration and a folded configuration. The shield may also include mounting structures for attachment to a vehicle door. In the unfolded configuration, the lower panel is disposed below the upper panel, allowing for substantially full-height protection of a user. In the folded configuration, the lower panel is disposed in adjacent facing relation to the upper panel, reducing the height of the shield and allowing the shield to be mounted on a vehicle door by utilizing the mounting structures. The shield further includes at least one handle for aiding the user in holding the shield as well as to facilitate simple and rapid deployment of the shield and conversion of the shield from a folded to an unfolded configuration.

When mounted to a closed car door, the shield can offer ballistic protection for the torso and thighs of the vehicle occupant adjacent the door. When mounted to an open vehicle door, the shield can be converted to an unfolded configuration so as to provide protection for a person concealed behind the vehicle door. The shield may further be quickly detached from the vehicle door and converted to an unfolded configuration so as to provide substantially full-height protection for a standing user.

BRIEF DESCRIPTION OF THE FIGURES

Advantages of embodiments of the present invention will be apparent from the following detailed description of the exemplary embodiments. The following detailed description should be considered in conjunction with the accompanying figures in which.

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

Figure 1:
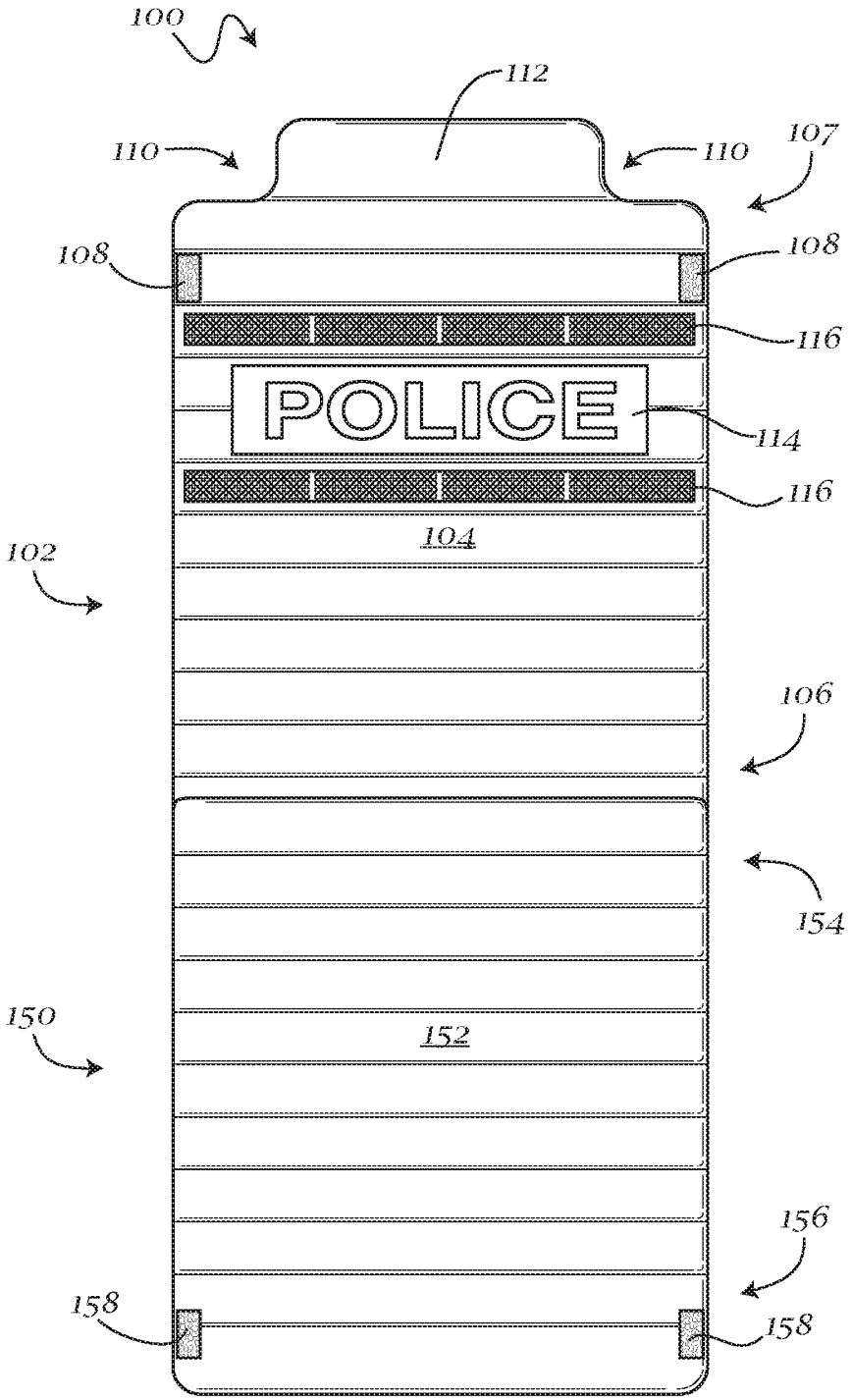
FIG. 1 is a front view of an exemplary embodiment of a ballistic shield.

According to at least one exemplary embodiment, a ballistic shield 100 is disclosed. Ballistic shield 100 can include an upper panel 102, and a lower panel 150 flexibly connected to upper panel 102. FIG. 1 shows ballistic shield 100 in an unfolded configuration, showing the front face 104 of upper panel 102 and the front face 152 of lower panel 150. The upper end 154 of lower panel 150 may be pivotably connected to upper panel 102 substantially proximate the lower end 106 of upper panel 102. The pivotable connection between upper panel 102 and lower panel 150 can allow shield 100 to fold such that, when shield 100 is in a folded configuration, the front face 104 of upper panel 102 is disposed in adjacent, facing relation to the front face 152 of lower panel 150. To maintain shield 100 in a folded configuration, fasteners 108 are provided on the upper end 107 of upper panel 102, and complementary fasteners 158 are provided on the lower end 156 of lower panel 150. Fasteners 108, 158 may be hook-and-loop fasteners, magnetic fasteners, snaps, or any other fastener known in the art that allows shield 100 to function as described herein. When shield 100 is used in an unfolded configuration, the front faces 104, 152 are facing outwards from the user.

The upper end 107 of upper panel 102 can also include a pair of cutouts 110 defining a projection 112 therebetween. Cutouts 110 may be used for discharging a firearm therethrough while the user is shielded behind shield 100 and projection 112, as well as to allow the user to look through cutouts 110 while being substantially shielded behind shield 100 and projection 112. Upper panel 102 may further include indicia 114 and lighting elements 116. Indicia 114 may be any desired indicia, for example "POLICE". Lighting elements 116 may be selectively operable by the user of shield 100 and may include LEDs, strobe lights, or any other desired lighting device. Further indicia and lighting elements may be provided on the front face 154 of lower panel 150, if desired.

Figure 2:
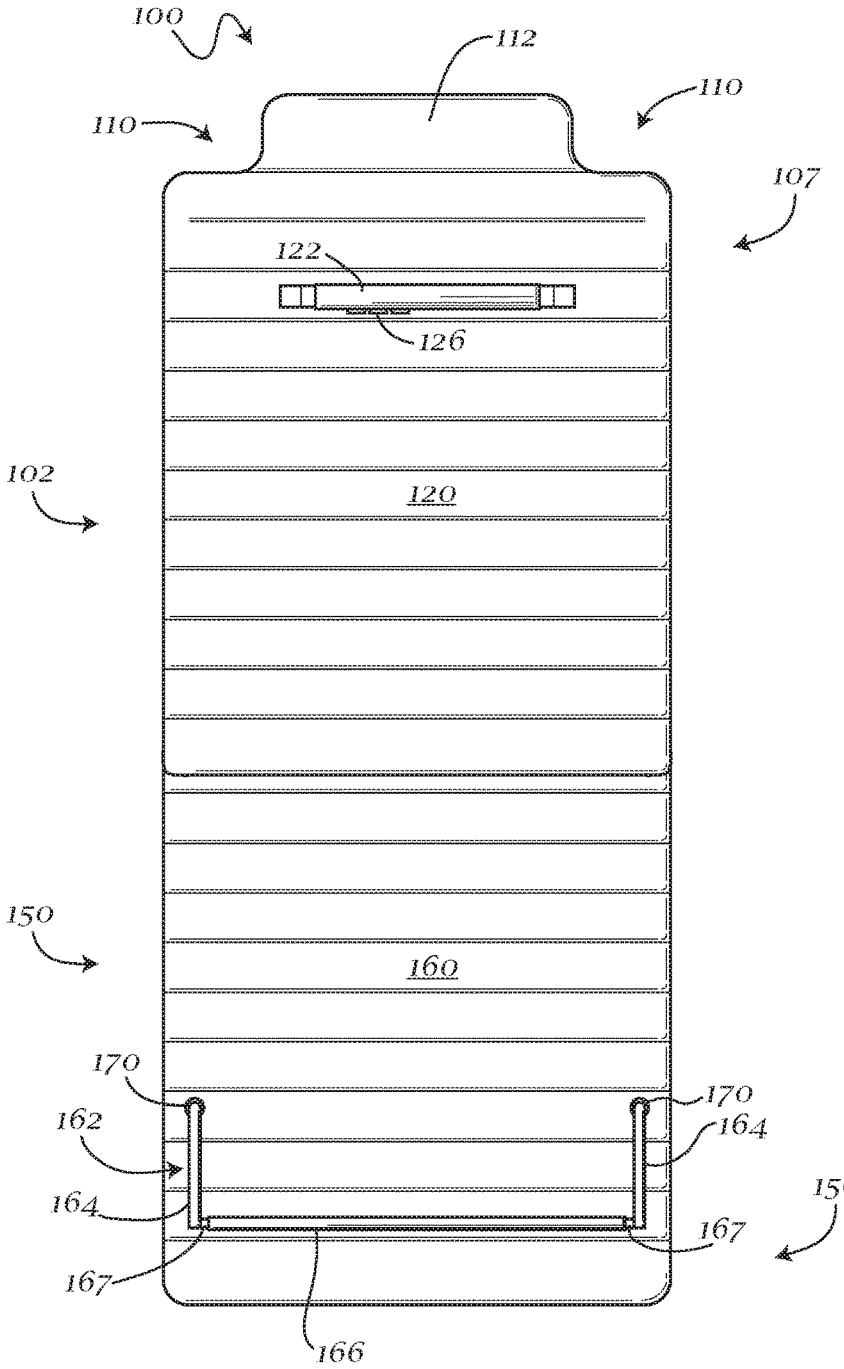
FIG. 2 is a rear view of an exemplary embodiment of a ballistic shield.
Figure 3:
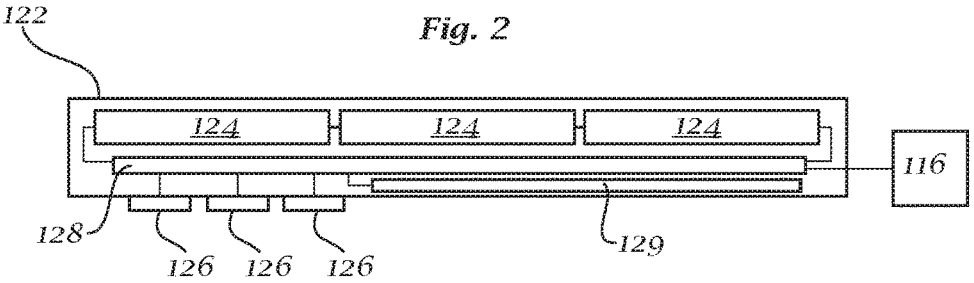
FIG. 3 is a diagram of a handle of an exemplary embodiment of a ballistic shield.

FIG. 2 shows a rear view of shield 100 in an unfolded configuration. Rear face 120 of upper panel 102 and rear face 160 of lower panel 150 are oriented towards the user of shield 100 when the shield is in an unfolded configuration. One or more handle 122 may be provided on rear face 120. Handle 122 can aid the user in holding the shield. One or more handle 122 may be oriented in any desired direction, for example horizontally, vertically or diagonally so as to allow the user to hold the shield as desired. As shown in FIG. 3, at least one of handles 122 may include batteries 124 for providing electrical power to lighting elements 116. Batteries 124 may be any desired type of battery that allows shield 100 to function as described herein, and may be replaceable and/or rechargeable batteries, as known in the art. Additionally, at least one of handles 122 may include one or more user-operable switches 126, and may further include controller board 128 so as to allow the user to control the operation of lighting elements 116, for example by choosing desired operating modes, illumination patterns, flashing or strobing intervals, and so forth. Furthermore, at least one of handles 122 may include a pressure sensor, pressure-operated switch, or internally mounted switch 129, so as to allow a user to control the operation of lighting elements 116 by squeezing handle 122. In another exemplary embodiment, one of switches 126/129 may be operatively connected to fasteners 108. For example, fasteners 108 may include movable latches engageable with complementary fasteners 158. In such embodiments, operation of a switch 126/129 may result in disengagement of the latches from complementary fasteners 158, allowing for easy and rapid conversion of shield 100 from a folded configuration to an unfolded configuration. The switch-operable disengagement function may also be implemented in any other known manner that may be contemplated or desired.

Figure 4:
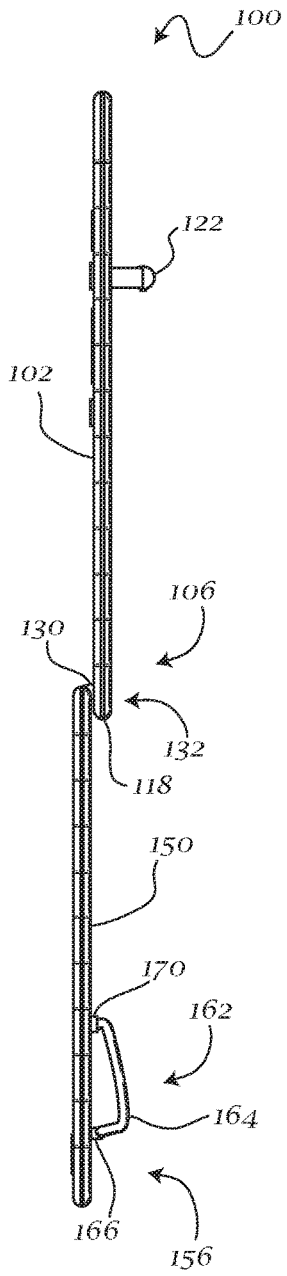
FIG. 4 is a side view of an exemplary embodiment of a ballistic shield.

Turning to FIG. 4, pivotable connection 130 between upper panel 102 and lower panel 150 may be provided in any desired manner, for example one or more hinges coupled to both upper panel 102 and lower panel 150. Alternatively, pivotable connection 130 may be provided by way of fabric portions that are coupled to both upper panel 102 and lower panel 150. The fabric portions may be coupled to panels 102, 150 in any desired manner, for example by stitching, sewing, or any other known attachment manner. The pivotable connection 130 can be attached to upper panel 102 substantially at the lower end 106 of the front face 104 thereof, but is also spaced apart from the lower edge 118 of upper panel 102. The spacing between pivotable connection 130 and lower edge 118 provides an overlap region 132 between panels 102, 150, thereby providing additional reinforcement in the area of the pivotable connection and to reduce the risk of projectile penetration in the area of the pivotable connection.

Figure 5:
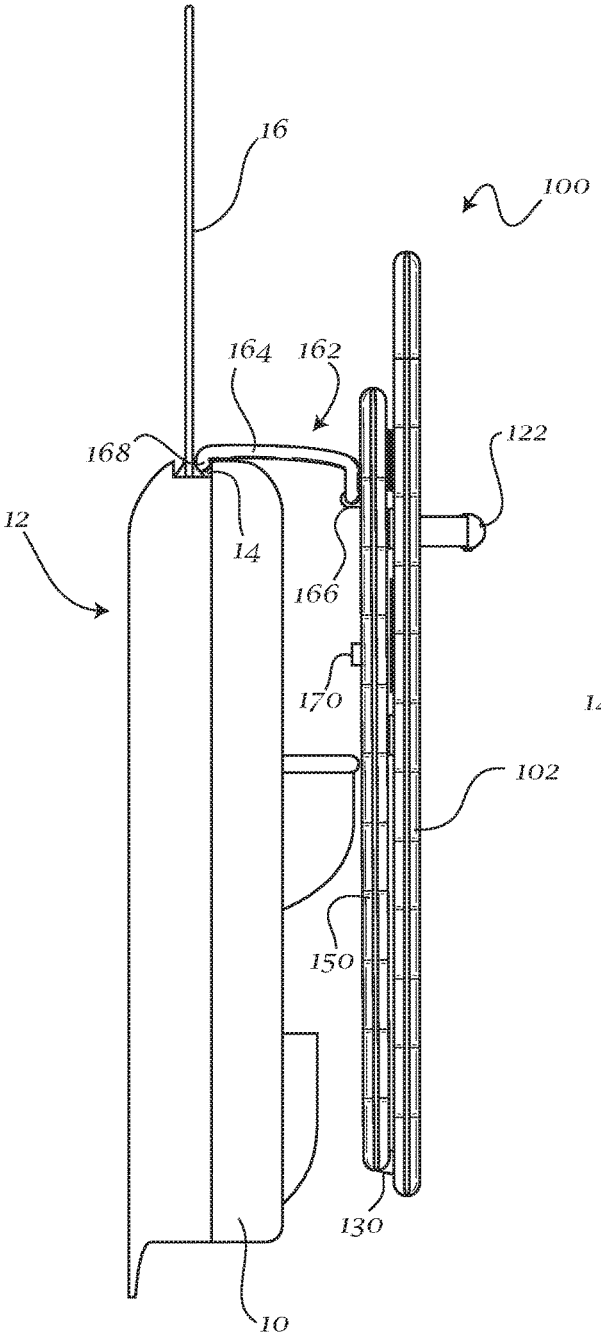
FIG. 5 is a side view of an exemplary embodiment of a ballistic shield in a folded configuration and mounted on a vehicle door.

As shown in FIGS. 2 and 4-5, a mounting member 162 is provided substantially at the lower end 156 of lower panel 150, on the rear face 160 thereof mounting member 162 can facilitate suspending shield 100 on a door card of a vehicle door, or over the door, as desired. Mounting member 162 can include a pair of arcuate members 164 pivotably connected to lower panel 150. The pivotable connection may be facilitated by at least one housing 166, that is fixedly coupled to lower panel 150 or by any other manner of pivotable connection that allows shield 100 to function as described herein. Arcuate members 164 may be pivotably coupled to housing 166 by way of connecting members 167 that are rotatably engaged with housing 166, or by way of a transverse cylindrical member (not shown) extending between and fixedly coupled to both arcuate members 164 and rotatably disposed within housing 166. The distal ends 168 of arcuate members 164 can be detachably coupled to rear face 160 of rear panel 150 via any desired couplings 170 that detachably engages with distal ends 168. As an example, couplings 170 may detachably engage with distal ends 168 by way of friction fit, magnetic coupling, hook and loop fasteners, or any other know detachable connection that enables shield 100 to function as described herein. The detachable coupling facilitates securely positioning mounting member 162 in a retracted position, as shown in FIGS. 2 and 4.

The distal ends 168 of arcuate members 164 may be insertable into a slit or opening 14 between the door card 10 of a vehicle door 12 and the window 16 of the vehicle door. Shield 100 can consequently be securely mounted on the inside of door 12. Alternatively, shield 100 may be mounted such that arcuate members 164 are disposed over the bottom edge of the window opening of vehicle door, with the window open, such that distal ends 168 are disposed on the outside of the vehicle. The dimensions and configuration of mounting member 162 and insert portion 168 can be adapted for a particular vehicle model, or may be provided as a "universal" configuration that is compatible with a plurality of vehicle models. Furthermore, in some exemplary embodiments, arcuate member 164 may be extendable, for example by including a plurality of telescopic members (not shown) so as to allow the distance between housing 166 and distal ends 168 to be increased or decreased as desired, thereby allowing mounting member 162 to be adapted to a variety of door and door card widths.

Figure 6:
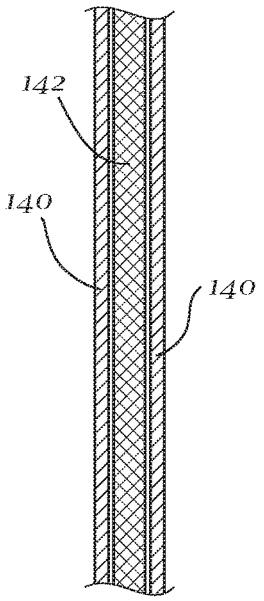
FIG. 6 is a cross-section of a panel of an exemplary embodiment of a ballistic shield.

FIG. 6 shows an exemplary cross-section of a panel of shield 100, which may be representative of upper panel 102 and/or lower panel 150. An external cover 140 can enclose a ballistic panel 142. External cover 140 can be formed from, for example, a ballistic fabric, nylon, polyethylene, cotton, Cordura, Gore-Tex, or any other material known in the art. Ballistic panel 142 may be formed from a ballistic material, such as, for example, woven ballistic fabric, bi-directional composite ballistic fabric, Kevlar, Spectra, or any other ballistic material known in the art. The thickness, weight, and other configuration of the ballistic material of ballistic panel 142 may be varied depending on the desired ballistic protection requirements. For example the ballistic material of ballistic panel 142 may be rated for a National Institute of Justice (NIJ) Threat Level IIIA, or for any other NIJ threat level, such as a I, II, IIA, or III threat level, as desired.

In operation, shield 100 may be placed into a folded configuration and attached to a vehicle door 12, substantially as shown in FIG. 5. The dimensions of mounting member 162, or, in certain embodiments, the adjustability of mounting member 162, can allow shield 100 to be spaced apart from door card 10 such that shield 100 is in a substantially vertical orientation. Shield 100 can thus provide ballistic protection over a significant portion of the vehicle door, and may be positioned such that shield 100 substantially overlaps the torso and thighs of the vehicle driver. Additionally, projection 112 may extend partially into the window area of the vehicle door, providing additional protection for the upper body.

In a threat situation, shield 100 may be used in the following exemplary and non-limiting manners. After opening vehicle door 12, the user may wish to utilize the vehicle door as concealment from the threat. In such a situation, shield 100 may quickly be converted from a folded to an unfolded configuration by disengaging fasteners 108, 158 without removing shield 100 from door 12. Consequently, lower panel 150 can remain coupled to the vehicle door, while upper panel 102 may extend below lower panel 150 and substantially until the ground, thereby providing additional concealment and ballistic protection for the user. Additionally, the user may utilize cutaways 110 to support, aim, and discharge a firearm while being protected by shield 100.

Shield 100 may also be decoupled from the vehicle door and utilized by the user while standing or moving. In this situations, shield 100 is first removed from the vehicle door and mounting member 162 may be fastened to coupling 170 so as to fix mounting member 162 in position. Shield 100 may then be converted from a folded to an unfolded configuration by disengaging fasteners 108, 158. In the unfolded configuration, shield 100 may be held by the user by handle 122, with upper panel 102 and lower panel 150 providing ballistic protection for substantially the majority of the user's body. While behind shield 100, the user may further utilize cutaways 110 to support, aim, and discharge a firearm, or for looking therethrough.

Figure 7A:
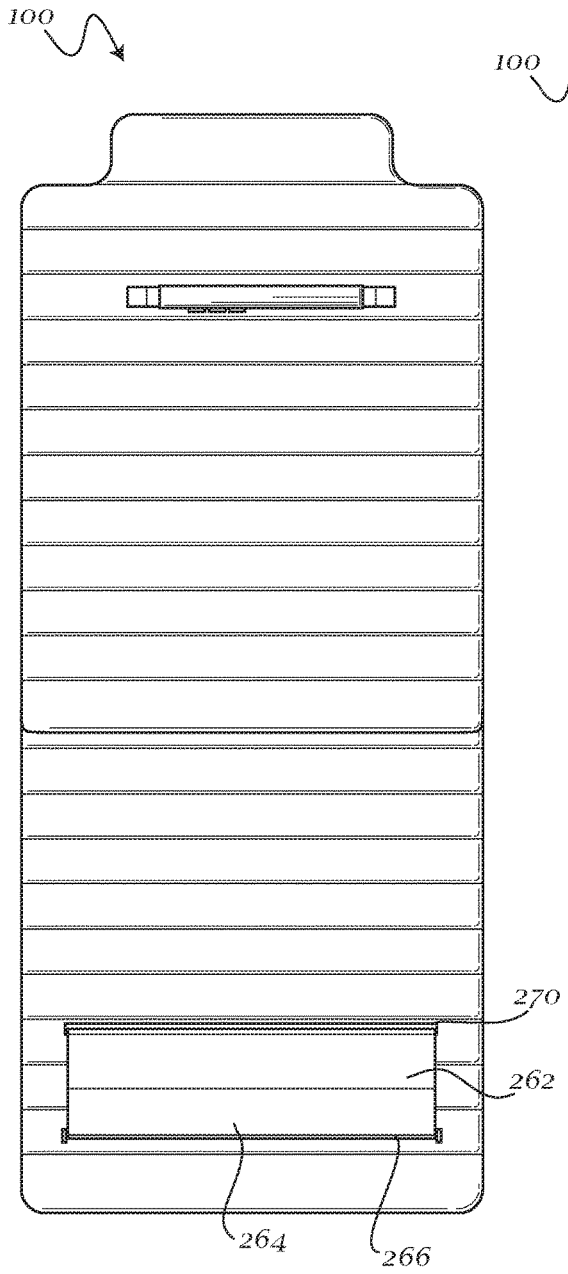
FIG. 7*a* is a rear view of a second exemplary embodiment of a ballistic shield.
Figure 7B:
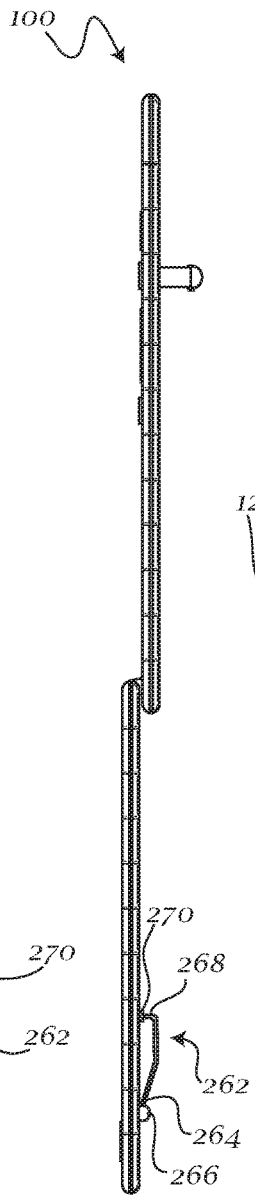
FIG. 7*b* is a side view of a second exemplary embodiment of a ballistic shield.
Figure 7C:
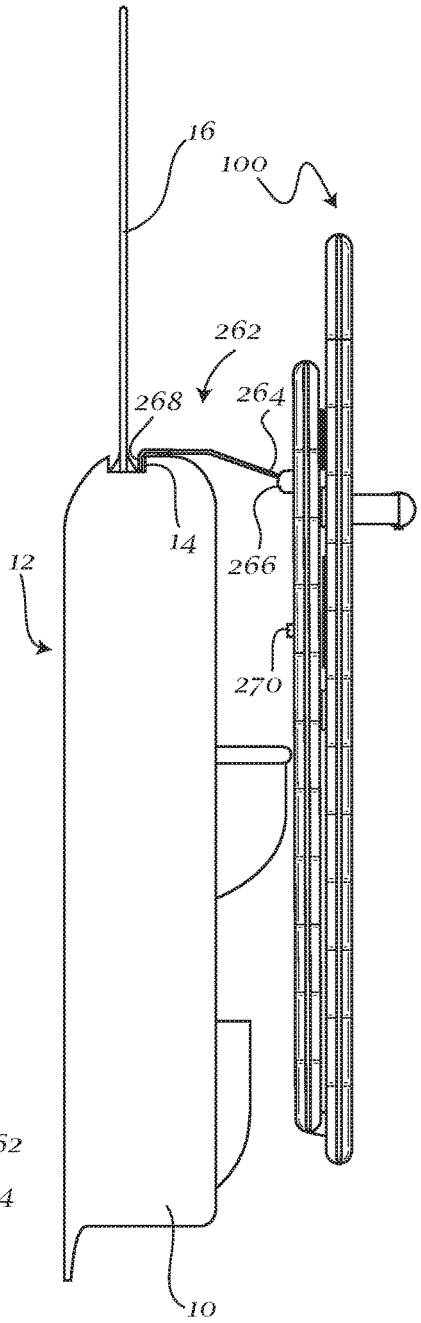
FIG. 7*c* is a side view of a second exemplary embodiment of a ballistic shield in a folded configuration and mounted on a vehicle door.

FIGS. 7*a*-7*c* show another exemplary embodiment of shield 100, with an alternate configuration for mounting member 262. In the exemplary embodiment, mounting member 262 can facilitate suspending shield 100 on a door card of a vehicle door. Mounting member 262 can have a first end 264 that is pivotably connected to lower panel 150. The pivotable connection may be facilitated by at least one hinge 266, or by any other manner of pivotable connection that allows shield 100 to function as described herein. A second end 268 of mounting member 262 can be detachably coupled to rear face 160 of rear panel 150 via any desired coupling 270 that detachably engages with second end 268. As an example, coupling 270 may detachably engage with second end 268 by way of friction fit, magnetic coupling, hook and loop fasteners, or any other know detachable connection that enables shield 100 to function as described herein. The detachable coupling facilitates securely positioning mounting member 262 in a retracted position, as shown in FIGS. 2 and 4.

As shown in FIG. 7*c*, when mounting member 262 is in an extended position, second end 268 can be inserted into a slit or opening 14 between the door card 10 of a vehicle door 12 and the window 16 of the vehicle door. Shield 100 can consequently be securely mounted on the inside of door 12. The dimensions and configuration of mounting member 262 and second end 268 can be adapted for a particular vehicle model, or may be provided as a "universal" configuration that is compatible with a plurality of vehicle models. In yet another exemplary embodiment, mounting member 262 may include structures (not shown) that allow for the adjustability of the span of mounting member 262, so as to allow the distance between first end 264 and second end 268 may be increased or decreased as desired.

Figure 8B:
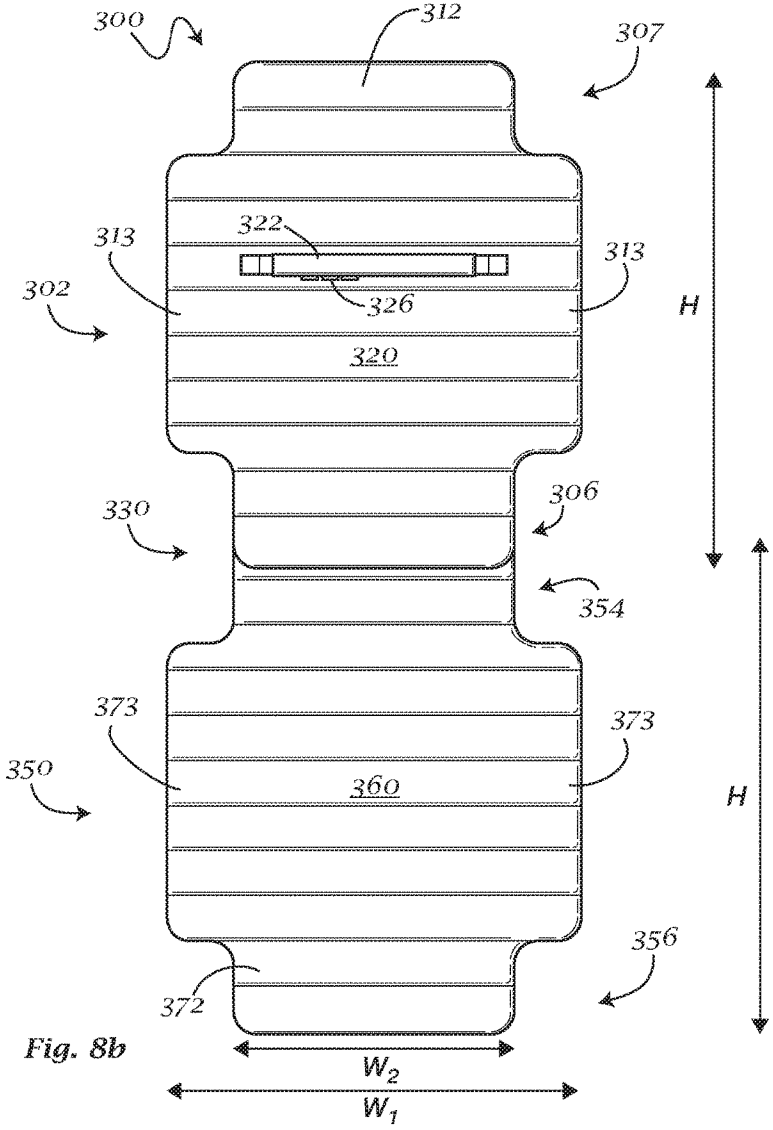
FIG. 8*b* is a rear view of a third exemplary embodiment of a ballistic shield.
Figure 8A:
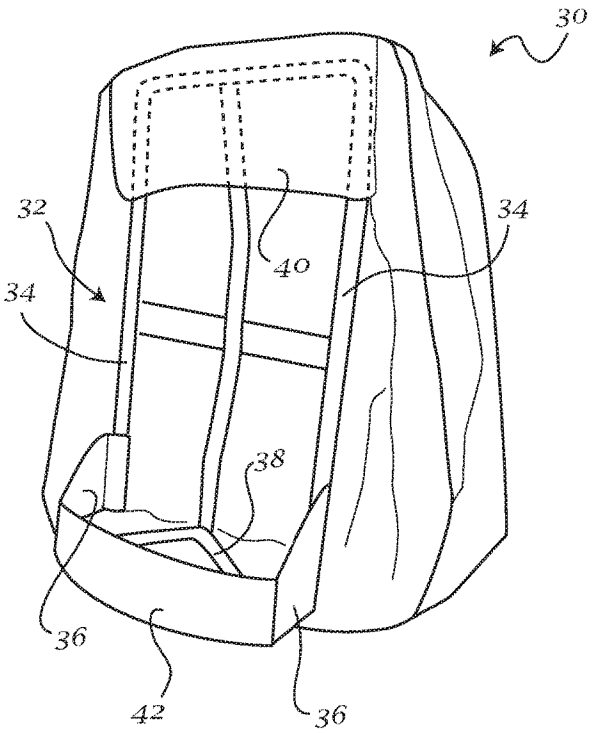
FIG. 8*a* shows an exemplary military rucksack and frame.

FIGS. 8*a*-8*d* show another exemplary embodiment of ballistic shield 300. Shield 300 may be adapted to fit within the frame 32 of a rucksack 30. FIG. 8*a* shows a rucksack 30 that is commonly used by the United States Armed Forces, for example an LCII-style rucksack. Frame 32 of rucksack 30 is disposed at the rear of the rucksack and includes a pair of vertical side members 34, a pair of lower buttress members 36, and an angled transverse member 38 extending between buttress members 36. The upper end of frame 32 is inserted into an upper pocket 40 of rucksack 30, and a flexible brace member 42 extends between buttress members 34.

The exemplary embodiment of ballistic shield 300 is shown in FIG. 8*b*. Features of ballistic shield 300 that are similar to features of the embodiment of ballistic shield 100 are indicated by similar numerals, but with a hundreds digit of 3. It should be appreciated that shield 300 includes features that are substantially similar to the features of shield 100, except for the differences described below.

Upper panel 302 of ballistic shield 300 can include an upper projection 312 at upper end 307, as well as a pair of side projections 313 extending laterally from the side edges of upper panel 302. Similarly, lower panel 350 of ballistic shield 300 can include a lower projection 372 at lower end 356, and a pair of side projections 373 extending laterally from the side edges of lower panel 350. Lower panel 350 does not include any mounting members for attaching ballistic shield 300 to a vehicle door. As shown in FIG. 8*b*, exemplary measurements for upper panel 302 can include a height H of about 17.5 inches, a first width $W_1$ of about 14 inches, and a second width $W_2$ of about 11.75 inches. Exemplary measurements for lower panel 350 can include a height H of about 17.5 inches, a first width $W_1$ of about 14 inches, and a second width $W_2$ of about 11.75 inches. Such a configuration of shield 300 may be used with ballistic panels rated for NIJ Threat Levels I, II, IIA, and IIIA.

When shield 300 is in a folded configuration, upper panel 302 and lower panel 350 may overlap substantially coextensively. This allows shield 300 to be inserted into and maintained within frame 32 of a rucksack 30, as shown in FIG. 8*c*. To that end, upper projection 312 and lower projection 372 may be inserted into upper pocket 40 of rucksack 30, side projections 313, 373 can extend over vertical side members 34, while lower end 306, upper end 354, and pivotable connection 330 may be inserted into the space defined by buttress members 36, transverse member 38, and flexible brace member 42. Furthermore, handle 322 can have a substantially flattened configuration so as to minimize the protrusion of the handle from the shield. Shield 300 can thus be easily carried with a rucksack, and deployed for use as desired by removing the shield from the frame and unfolding it as described herein. In addition, the rucksack may be placed on the ground by the user in a threat situation, without removing the shield from the frame. With the user positioned behind the rucksack, the rucksack with the shield can thus be used as protective cover, and can also provide a stable platform for shooting over and around the rucksack.

Figure 8D:
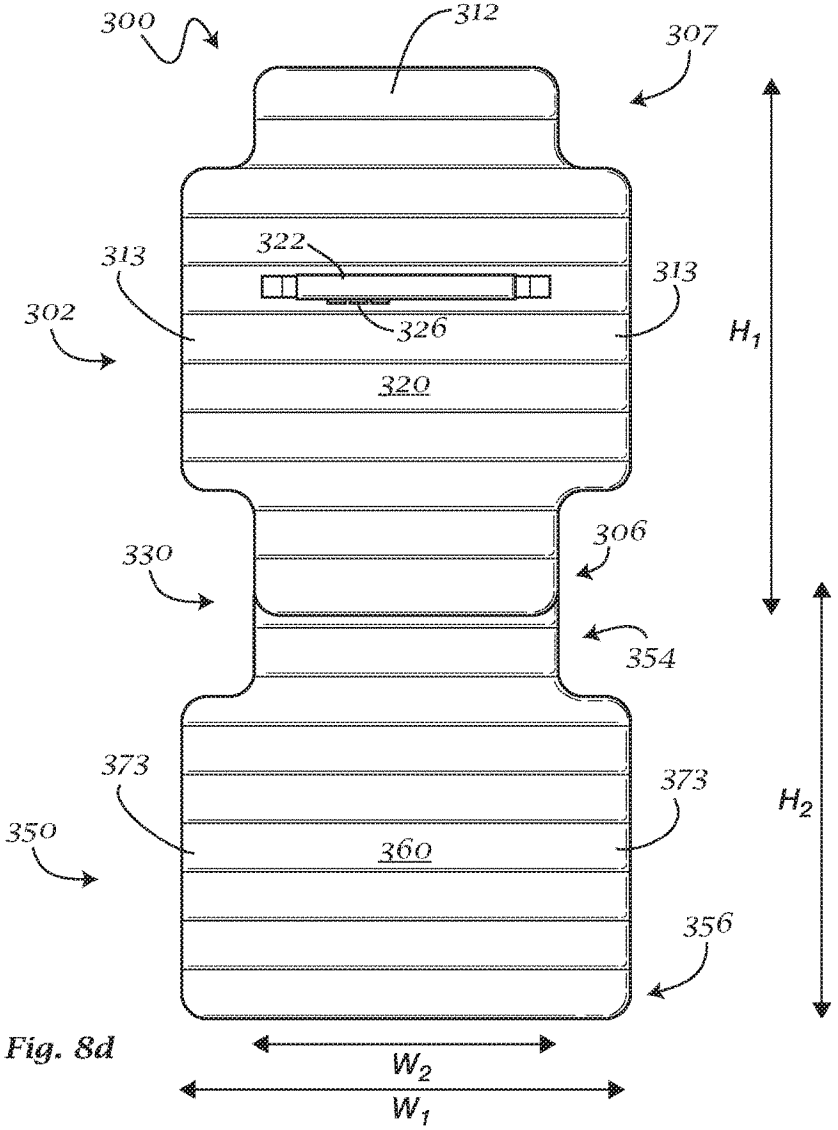
FIG. 8*d* is a rear view of a fourth exemplary embodiment of a ballistic shield.
Figure 8C:
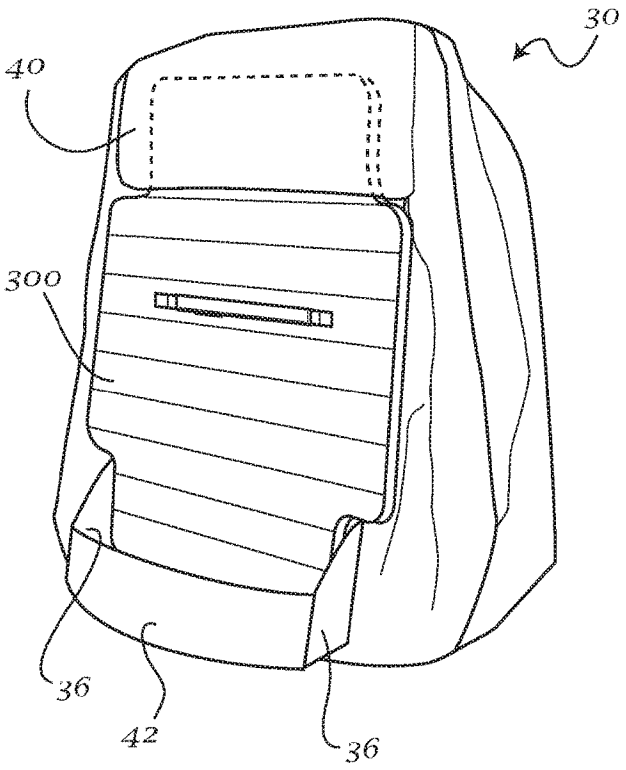
FIG. 8*c* shows a third exemplary embodiment of a ballistic shield coupled to an exemplary military rucksack.

Another exemplary embodiment of shield 300 is shown in FIG. 8*d*. The embodiment of FIG. 8*d* may be used with ballistic panels rated for NIJ Threat Level III, which are typically hard plates having an added thickness so as to provide ballistic protection against rounds fired from high-powered rifles. To allow the thicker ballistic panel to fit into pocket 40, this exemplary embodiment does not include lower projection 372. Consequently, exemplary measurements for upper panel 302 can include a first height $H_1$ of about 17.5 inches, a first width $W_1$ of about 14 inches, and a second width $W_2$ of about 11.75 inches, while exemplary measurements for lower panel 350 can include a second height $H_2$ of about 13 inches, a first width $W_1$ of about 14 inches, and a second width $W_2$ of about 11.75 inches.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A ballistic shield convertible between a folded configuration and an unfolded configuration, comprising:

a first ballistic panel having an upper end, a lower end, a front face, a rear face, and including a ballistic material;

a second ballistic panel having an upper end, a lower end, a front face, a rear face, and including a ballistic material, the second ballistic panel being pivotably connected to the first ballistic panel;

a mounting member coupled to the rear face of the second panel, the mounting member being adapted for attachment to a vehicle door such that the second panel of the ballistic shield is disposed in a substantially vertical orientation adjacent an interior panel of the vehicle door; and a handle;

wherein, when the ballistic shield is in the unfolded configuration, a portion of the lower end of the first ballistic panel overlaps a portion of the upper end of the second ballistic panel;

when the ballistic shield is in the unfolded configuration, the plane of the front face of the first ballistic panel is parallel to, but not coplanar with, the plane of the front face of the second ballistic panel; and wherein, when attached to the vehicle door, the ballistic shield remains convertible between a folded configuration and an unfolded configuration, such that, when the ballistic shield is in the folded configuration, the ballistic shield is disposed above a lower edge of the vehicle door, and, when the ballistic shield is in the unfolded configuration, the first ballistic panel extends below the lower edge of the vehicle door.

2. The ballistic shield of claim 1, wherein the second ballistic panel is pivotably connected to the first ballistic panel at or proximate the overlap of the first panel and the second panel.

3. The ballistic shield of claim 1, wherein, when the shield is in the unfolded configuration, a portion of the front face of the first panel is in adjacent facing relation to a portion of the rear face of the second panel, at the-overlap of the first panel and the second panel.

4. The ballistic shield of claim 1, wherein, when the shield is in the folded configuration, the front face of the first panel is in adjacent facing relation to the front face of the second panel.

5. The ballistic shield of claim 1, further comprising lighting elements disposed on the front face of the first panel.

6. The ballistic shield of claim 5, further comprising user-operable switches disposed on the handle.

7. The ballistic shield of claim 1, further comprising fasteners disposed on the front face of the first panel, and complementary fasteners disposed on the front face of the second panel.

8. The ballistic shield of claim 1, wherein the ballistic shield is sized and shaped to fit within a frame of a rucksack.

9. A ballistic shield convertible between a folded configuration and an unfolded configuration, comprising:

a first ballistic panel including a ballistic material;

a second ballistic panel including a ballistic material;

a pivotable connection between the first ballistic panel and the second ballistic panel, the pivotable connection being disposed such that, when the ballistic shield is in the unfolded configuration, a portion of the first ballistic panel overlaps a portion of the second ballistic panel;

a mounting member coupled to the second panel, the mounting member being adapted for attachment to a vehicle door such that the second panel of the ballistic shield is disposed in a substantially vertical orientation adjacent an interior panel of the vehicle door and the pivotable connection is disposed above a lower edge of the vehicle door; and a handle;

wherein, when the ballistic shield is in the unfolded configuration, the plane of the first ballistic panel is parallel to, but not coplanar with, the plane of the second ballistic panel; and wherein, when attached to the vehicle door, the ballistic shield remains convertible between a folded configuration and an unfolded configuration, such that, when the ballistic shield is in the unfolded configuration, the first ballistic panel extends below the lower edge of the vehicle door.

10. The ballistic shield of claim 9, wherein, when the shield is in the folded configuration, the first ballistic panel and the second ballistic panel substantially overlap.

11. The ballistic shield of claim 9, wherein the pivotable connection is one of a hinge or a fabric connection.

12. The ballistic shield of claim 9, further comprising fasteners disposed on a front face of the first panel, and complementary fasteners disposed on a front face of the second panel.

13. The ballistic shield of claim 1, wherein the ballistic shield is sized and shaped to fit within a frame of a rucksack.

14. A ballistic shield convertible between a folded configuration and an unfolded configuration, comprising:

a first ballistic panel having an upper end, a lower end, a front face, a rear face, and including a ballistic material;

a second ballistic panel having an upper end, a lower end, a front face, a rear face, and including a ballistic material, the second ballistic panel being pivotably connected to the first ballistic panel by a pivotable connection coupled to the front face of the first ballistic panel;

a mounting member coupled to the rear face of the second panel, the mounting member being adapted for attachment to a vehicle door such that the second panel of the ballistic shield is disposed in a substantially vertical orientation adjacent an interior panel of the vehicle door; and a handle;

wherein, when the ballistic shield is in the unfolded configuration, the lower end of the first ballistic panel overlaps the upper end of the second ballistic panel;

when the ballistic shield is in the unfolded configuration, the plane of the front face of the first ballistic panel is parallel to, but not coplanar with, the plane of the front face of the second ballistic panel;

the shield converts between the folded configuration and the unfolded configuration by pivoting the second ballistic panel about the pivotable connection; and wherein, when attached to the vehicle door, the ballistic shield remains convertible between a folded configuration and an unfolded configuration, such that, when the ballistic shield is in the folded configuration, the ballistic shield is disposed above a lower edge of the vehicle door, and, when the ballistic shield is in the unfolded configuration, the first ballistic panel extends below the lower edge of the vehicle door.

15. The ballistic shield of claim 14, wherein, when the shield is in the folded configuration, a portion of the front face of the first panel is in adjacent facing relation to a portion of the front face of the second panel.

16. The ballistic shield of claim 14, further comprising fasteners disposed on the front face of the first panel, and complementary fasteners disposed on the front face of the second panel.

17. The ballistic shield of claim 14, wherein the ballistic shield is sized and shaped to fit within a frame of a rucksack.

* * * * *